United States Patent [19]

Malek

[11] 4,085,029

[45] Apr. 18, 1978

[54] METHOD FOR SEPARATING LIQUID AND SOLID PRODUCTS OF LIQUEFACTION OF COAL OR LIKE CARBONACEOUS MATERIALS

[76] Inventor: John M. Malek, P.O. Box 71, Lomita, Calif. 90717

[21] Appl. No.: 648,108

[22] Filed: Jan. 12, 1976

[51] Int. Cl.[2] ..... C10G 1/04

[52] U.S. Cl. ..... 208/8; 210/56

[58] Field of Search ..... 208/8, 263, 10; 210/56

[56] References Cited

U.S. PATENT DOCUMENTS

| | | | |
|---|---|---|---|
| 1,794,865 | 3/1931 | Pier et al. | 208/8 |
| 1,925,551 | 9/1933 | Wietzel et al. | 208/8 |
| 2,202,901 | 6/1940 | Dreyfus | 208/8 |
| 2,266,359 | 12/1941 | Edwards et al. | 208/263 |
| 2,605,212 | 7/1952 | Lobban | 208/263 |
| 2,654,695 | 10/1953 | Gilbert et al. | 208/10 |

*Primary Examiner*—Delbert E. Gantz
*Assistant Examiner*—James W. Hellwege

[57] ABSTRACT

A method of improving the quality of slurry products taken from coal liquefaction reactors comprising subjecting the slurry to treatment with an alkaline compound such as caustic soda in the presence of steam in order to decompose the phenolic and acidic materials present in the slurry, and to also lower the slurry viscosity to allow separation of solid particles by sedimentation.

10 Claims, 1 Drawing Figure

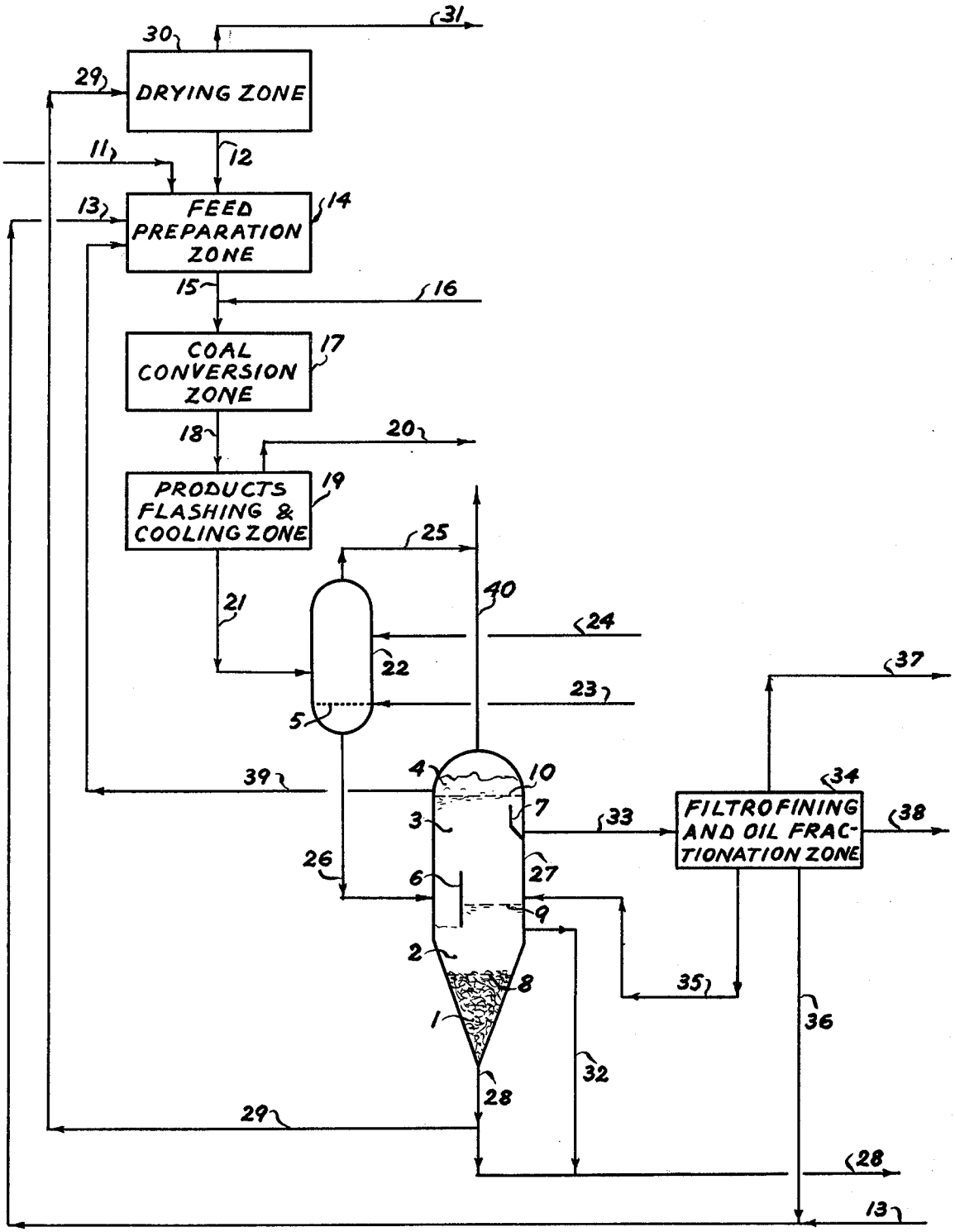
DRYING ZONE
FEED PREPARATION ZONE
COAL CONVERSION ZONE
PRODUCTS FLASHING & COOLING ZONE
FILTROFINING AND OIL FRACTIONATION ZONE
30
31
29
11
12
13
14
15
16
17
18
20
19
25
40
21
24
22
23
5
37
39
4
10
34
7
33
38
3
26
27
6
9
2
8
35
1
36
32
28
29
28
13

METHOD FOR SEPARATING LIQUID AND SOLID PRODUCTS OF LIQUEFACTION OF COAL OR LIKE CARBONACEOUS MATERIALS

This invention relates to a method for improving the separability of liquids and solids originating from chemical reactors like carbonizers or hydrogenators for converting carbonaceous solids such as coal into liquid hydrocarbons.

It is known that one of major problems in various coal carbonization or liquefaction technologies is the difficulty of separating carbonaceous and mineral solid particles from relatively viscous liquid hydrocarbon type solutions originating from the chemical reactor in which the coal or like material was subjected to conversion conditions including relatively high temperatures, and preferably - further including reactive hydrogen in presence of catalysts. In fact, the known separation techniques including filtration or other operations, like centrifugation, characterized by not a fully continuous regime, generally constitute production bottlenecks when applied to viscous suspensions of solid particles comprised of a broad range of sizes including the submicron ones especially when such suspensions have to be handled in large flow rates under high pressures and temperatures as is usually the case in separating the products of conversion of carbonaceous solids into useful products. Such severe operating conditions result in lower outputs and in mechanical and maintenance problems related to the process equipment, and give rise to inefficient and costly technologies.

One object of the invention is to replace the uneconomical operations of separating solids from a liquid carrier in carbonaceous product slurries by a more efficient and economical operation, preferably of a fully continuous type, thus providing an improved process for converting coal or other carbonaceous solid materials into useful products.

Another object is to improve the quality of the liquid and slurryform products resulting from the conversion of solid carbonaceous materials in such a manner that the liquid and solid constituents of the slurry may be more readily separable.

It is known that one major cause of difficulties in separating solid particulates from liquid solutions inherent to processes for converting coal or like carbonaceous materials into hydrocarbons lies in the high viscosity of these solutions, and it has been found that this high viscosity is substantially imparted to the liquid by the presence therein of phenolic and like acidic organic materials bound with arylamines and like base type organic compounds into complex interlinked chemical structures of a relatively high molecular weight.

Therefore an early decomposition of such acid-base, high molecular weight materials in effluents from reactors for conversion of carbonaceous solids would be advantageous for decreasing the viscosity of the liquid part of these effluents while also easing the extraction of solids, especially if the products of such decomposition may be utilized economically.

A main feature of this invention for attaining the above objects consists in reacting the slurryform part of the effluents from the carbonaceous solids conversion zone with at least one of the following compounds: alkali metal hydroxide, alkaline earth metal hydroxide, ammonium hydroxide, alkali metal carbonate(s), or a similar stronger base compound. Said chemicals are mixed with the slurryform part of the effluent, in order to disintegrate, to " wet," and to obtain separate mineral particles and organic fractions, while decomposing the decomposable materials, then separating at least a part of the products of the reaction, before subjecting at least a part of these products to further processing.

The accompanying drawing shows how the invention can be used and constitutes a flow diagram including the steps of the invention.

As shown by the drawing, the powdered coal at line 11, together with relatively dry particulate solids at line 12, and solvent at line 13, are fed to the Feed Preparation Zone 14 where they are thoroughly mixed together, and the resulting slurryform or pasteform mixture is transferred through line 15 along with hydrogen rich gas from line 16, through a preheater (not shown), into the Coal Conversion Zone 17 wherein the mixture is subjected, under a pressure in the range of up to 200 atmospheres and a temperature in the range of 350°–550° C, to a reaction with hydrogen; the reaction products are passed through line 18 into the Products Flashing & Cooling Zone 19 wherein they are flashed under a decreased pressure, thus giving rise to a formation of gasiform and slurryform products, the gasiform products being taken-off through line(s) 20, and the slurryform products passed through line 21 into mixing vessel 22. The mixing vessel is provided with a steam sparger 5 fed with steam from line 23. Slurryform products, under the effect of bubbling steam, are subjected to mixing and reacting with an alkali such as caustic soda or slaked lime fed into the mixing vessel through line 24. The vent gases together with uncondensed steam and vapor are removed from the vessel through line 25. The slurryform reaction products comprising freed weaker organic bases and salts and adducts of the alkali with phenols and with other organic acids are passed through line 26 into a settler-separator 27 wherein, in principle, four layers form. Most of the solids comprising insoluble products of alkaline reactions or simply wetted unreacted solid particles deposit at the bottom part of the vessel as a layer 1; a decanted aqueous solution comprising base metal salts of phenols and other organic acids, as well as other water soluble materials, plus some unsettled solid particles forms layer 2; a relatively pure oil phase with few solid fines forms layer 3; and at the top of this layer, a relatively thin layer of froth comprising light solid particles and aqueous droplets in suspension in oil forms layer 4, the baffles 6 and 7 serving to better separate these layers. The numbers 8, 9 and 10 indicate respectively the interfaces between layers 1 and 2, 2 and 3 and 3 and 4 in the settler 27.

The wet solids from the layer 1 are passed into line 28; a part of them is recycled therefrom through line 29 to the Drying Zone 30 wherein after removing at least a part of the moisture through line 31, the relatively dry solids are passed into the line 12. The remaining part of the solids from the layer 1, along with the solution from the layer 2 is withdrawn from the settler 27 through line 32 connected to line 28, and removed from the system represented on the flow diagram, for further processing.

The oil + fines from layer 3 are passed through line 33 to a Filtrofining and Oil Fractionation Zone 34, wherein the oil is first subjected to filtration for separating the solid fines, the fines being removed as a concentrated suspension in a relatively small portion of oil, which suspension with the carrier oil is then recycled through line 35 to the settler - separator 27; the major portion of the oil in its filtrated form is then fractionated by distillation, one resulting fraction being recycled as solvent through line 36 and line 13 to the Feed Preparation Zone 14, the gasiform fraction being removed through line 37, and the remaining oil fractions being sent, to further processing (not shown) through header 38 which may represent several ducts.

The froth trom the top layer 4 with an appropriate minimum of oil from layer 3 is recycled through line 39 to the Feed Preparation Zone 14 wherein this froth is admixed to the coal feed.

Any gasiform products present above the froth layer in the settler 27 may be vented through line 40 to which the line 25 may be connected.

Since many possible embodiments may be made of the invention without departing from the scope thereof, it is to be understood that all matter herein set forth or shown in the accompanying drawing is to be interpreted as illustrative and not in a limiting sense.

What I claim is:

1. In a process for converting coal into coal derived hydrocarbons by subjecting subdivided coal in the presence of a coal derived solvent and hydrogen to the effects of elevated pressure and temperature in a converter, in which process gasiform products are separated from slurryform products, the improvement for increasing the efficiency of separation of coal derived solids contained in said slurryform, comprising treating at least a part of the said slurryform in the presence of bubbling steam with an alkaline compound selected from the group consisting of alkali and alkaline earth metal hydroxides, ammonium hydroxide, and alkali metal carbonates, and subjecting the treated slurryform product to gravity settling and forming, in a gravity settler, a solids rich fraction as a lower layer, a predominantly aqueous fraction as an intermediate liquid layer, a hydrocarbon liquid rich portion as an upper layer, and a froth fraction with entrained solid fines aqueous droplets gas bubbles suspended in an oil medium as a top layer, and withdrawing at least a part of the solids rich layer from the gravity settler.

2. The process of claim 1 further comprising withdrawing from said gravity settler and separating at least a part of the contents of said hydrocarbon liquid rich portion into two portions: an oil portion, and solid fines rich portion.

3. The process of claim 1 further comprising withdrawing from said gravity settler at least a part of said hydrocarbon liquid rich portion and subjecting the latter to a fractionating distillation, at least a part of the yielded fractionation products being then used as said coal derived solvent for converting coal into hydrocarbons.

4. The process of claim 1 further comprising recycling to said converter at least a part of the solids from the said solids rich fraction withdrawn from the gravify settler.

5. The process of claim 1 further comprising recycling at least a part of the contents of said froth fraction to said converter.

6. The process of claim 1 wherein said alkaline compound comprises an alkali metal hydroxide.

7. The process of claim 6 wherein said alkali metal hydroxide is sodium hydroxide.

8. The process of claim 1 wherein said alkaline compound comprises an alkaline earth metal hydroxide.

9. The process of claim 1 wherein said alkaline compound comprises ammonium hydroxide.

10. The process of claim 1 wherein said alkaline compound comprises an alkali metal carbonate.

* * * * *